US007067020B2

(12) United States Patent
Poon et al.

(10) Patent No.: US 7,067,020 B2
(45) Date of Patent: Jun. 27, 2006

(54) BULK-SOLIDIFYING HIGH MANGANESE NON-FERROMAGNETIC AMORPHOUS STEEL ALLOYS AND RELATED METHOD OF USING AND MAKING THE SAME

(75) Inventors: S. Joseph Poon, Charlottesville, VA (US); Gary J. Shiflet, Charlottesville, VA (US); Vijayabarathi Ponnambalam, Charlottesville, VA (US)

(73) Assignee: University of Virginia Patent Foundation, Charlottesville, VA (US)

( * ) Notice: Subject to any disclaimer, the term of this patent is extended or adjusted under 35 U.S.C. 154(b) by 255 days.

(21) Appl. No.: 10/364,123

(22) Filed: Feb. 11, 2003

(65) Prior Publication Data

US 2003/0164209 A1 Sep. 4, 2003

Related U.S. Application Data

(60) Provisional application No. 60/423,633, filed on Nov. 4, 2002, provisional application No. 60/418,588, filed on Oct. 15, 2002, provisional application No. 60/396,349, filed on Jul. 16, 2002, provisional application No. 60/355,942, filed on Feb. 11, 2002.

(51) Int. Cl.
*C22C 45/02* (2006.01)

(52) U.S. Cl. ..... 148/403; 420/14; 420/74

(58) Field of Classification Search ..... 148/304, 148/403

See application file for complete search history.

(56) References Cited

U.S. PATENT DOCUMENTS 2,535,068 A 12/1950 Johnson
2,853,040 A 9/1958 Grillo
4,053,330 A 10/1977 Henricks et al.
4,061,815 A 12/1977 Poole, Jr.
4,067,732 A * 1/1978 Ray ..... 148/403

(Continued)

FOREIGN PATENT DOCUMENTS

EP 0713925 A 5/1996

(Continued)

OTHER PUBLICATIONS

JP 53-057119 A (Tohoku University) May 24, 1978, abstract.

(Continued)

*Primary Examiner*—George Wyszomierski
(74) *Attorney, Agent, or Firm*—Robert J. Decker

(57) ABSTRACT

Iron based amorphous steel alloy having a high Manganese content and being non-ferromagnetic at ambient temperature. The bulk-solidifying ferrous-based amorphous alloys are multicomponent systems that contain about 50 atomic percent iron as the major component. The remaining composition combines suitable mixtures of metalloids (Group b elements) and other elements selected mainly from manganese, chromium, and refractory metals. Various classes of non-ferromagnetic ferrous-based bulk amorphous metal alloys are obtained. One class is a high-manganese class that contains manganese and boron as the principal alloying components. Another class is a high manganese-high molybdenum class that contains manganese, molybdenum, and carbon as the principal alloying components. These bulk-solidifying amorphous alloys can be obtained in various forms and shape for various applications and utlizations. The good processability of these alloys can be attributed to the high reduced glass temperature $T_{rg}$ (e.g., about 0.6 to 0.63) and large supercooled liquid region $\Delta T_x$ (e.g., about 50–100° C.).

47 Claims, 2 Drawing Sheets

U.S. PATENT DOCUMENTS

| | | | | |
|---|---|---|---|---|
| 4,353,305 | A | | 10/1982 | Moreau |
| 4,584,034 | A | * | 4/1986 | Hagiwara et al. ..... 148/304 |
| 4,676,168 | A | | 6/1987 | Cotton |
| 4,964,927 | A | | 10/1990 | Shiflet |
| 5,228,349 | A | | 7/1993 | Gee |
| 5,431,754 | A | | 7/1995 | Fujiwara et al. |
| 5,499,156 | A | | 3/1996 | Bentley |
| 5,522,948 | A | | 6/1996 | Sawa |
| 5,604,403 | A | | 2/1997 | Levy |
| 5,626,691 | A | | 5/1997 | Li |
| 5,728,968 | A | | 3/1998 | Buzzett |
| 5,732,771 | A | | 3/1998 | Moore |
| 5,738,733 | A | | 4/1998 | Inoue |
| 5,797,443 | A | | 8/1998 | Lin |
| 5,820,963 | A | | 10/1998 | Lu |
| 5,866,254 | A | | 2/1999 | Peker |
| 5,868,077 | A | | 2/1999 | Kuznetsov |
| 5,896,642 | A | | 4/1999 | Peker |
| 5,961,745 | A | | 10/1999 | Inoue |
| 5,976,274 | A | | 11/1999 | Inoue |
| 6,057,766 | A | | 5/2000 | O'Handley |
| 6,172,589 | B1 | | 1/2001 | Fujita |
| 6,280,536 | B1 | | 8/2001 | Inoue |
| 6,284,061 | B1 | | 9/2001 | Inoue |
| 6,357,332 | B1 | | 3/2002 | Vecchio |
| 6,446,558 | B1 | | 9/2002 | Peker |
| 6,505,571 | B1 | | 1/2003 | Critchfield |
| 6,515,382 | B1 | | 2/2003 | Ullakko |

FOREIGN PATENT DOCUMENTS

| | | | |
|---|---|---|---|
| JP | 07331396 | A | 12/1995 |
| JP | 09268354 | A | 10/1997 |
| JP | 2000054089 | A | 2/2000 |
| JP | 2000073148 | A | 3/2000 |
| WO | WO 98/22629 | | 5/1998 |

OTHER PUBLICATIONS

JP 54-048637 A (Nippon Steel Corp.) Apr. 17, 1979 abstract.
JP 11-186020 A (Toshiba Corp) Jul. 9, 1999 abstract.
JP 200234461 A (Hitachi Metals <LTD) Aug. 29, 2000 abstract.

* cited by examiner

BULK-SOLIDIFYING HIGH MANGANESE NON-FERROMAGNETIC AMORPHOUS STEEL ALLOYS AND RELATED METHOD OF USING AND MAKING THE SAME

CROSS-REFERENCES TO RELATED APPLICATIONS

The Present invention claims priority from U.S. Provisional Patent Applications Ser. No. 60/355,942 filed Feb. 11, 2002, entitled "Bulk-Solidifying High Manganese-High Molybdenum Amorphous Steel Alloys," Ser. No. 60/396,349 filed Jul. 16, 2002, entitled "Bulk-Solidifying High Manganese-High Molybdenum Non-Ferromagnetic Amorphous Steel Alloys", Ser. No. 60/418,588 filed Oct. 15, 2002, entitled "Bulk-Solidifying High Manganese Non-Ferromagnetic Amorphous Steel Alloys," and Ser. No. 60/423,633 filed Nov. 4, 2002, entitled "Bulk-Solidifying High Manganese Non-Ferromagnetic Amorphous Steel Alloys," the entire disclosures of which are hereby incorporated by reference herein in their entirety.

US GOVERNMENT RIGHTS

This invention was made with United States Government support under Grant No. N00014-01-1-0961, awarded by the Defense Advanced Research Projects Agency/Office of Naval Research. The United States Government has certain rights in the invention.

FIELD OF THE INVENTION

The present invention is directed to the field of amorphous steel alloys with high manganese content and related method of using and manufacturing the same.

BACKGROUND OF THE INVENTION

Bulk-solidifying amorphous metal alloys (a.k.a. bulk metallic glasses) are those alloys that can form an amorphous structure upon solidifying from the melt at a cooling rate of several hundred degrees Kelvin per second or lower. Most of the prior amorphous metal alloys based on iron are characterized by their soft-magnetic behavior, high magnetic permeability at high frequencies, and low saturated magnetostriction [1] [2]. The Curie temperatures are typically in the range of about 200–300° C. These alloys also exhibit specific strengths and Vickers hardness two to three times those of high-strength steel alloys; and in some cases, good corrosion-resistant properties have been reported. Ferrous-based metallic glasses have been mainly used for transformer, recording head, and sensor applications, although some hard magnetic applications have also been reported.

The bulk-solidifying ferrous-based amorphous alloys are multicomponent systems that contain 50–70 atomic percent iron as the major component. The remaining composition combines suitable mixtures of metalloids (Group b elements) and other elements selected from cobalt, nickel, chromium, and refractory as well as lanthanide (Ln) metals [2] [3]. These bulk-solidifying amorphous alloys can be obtained in the form of cylinder-shaped rods between one and six millimeters in diameter as well as sheets less than one millimeter in thickness [4]. The good processability of these alloys can be attributed to the high reduced glass temperature $T_{rg}$ (defined as glass transition temperature $T_g$ divided by the liquidus temperature $T_l$ in K) of about 0.6 to 0.63 and large supercooled liquid region $\Delta T_x$ (defined as crystallization temperature minus the glass transition temperature) of at least 20° C. that are measured.

SUMMARY OF INVENTION

The present invention amorphous steel alloy suppresses the magnetism compared with conventional compositions while still achieving a high processability of the amorphous metal alloys and maintaining superior mechanical properties and good corrosion resistance properties.

The present invention provides bulk-solidifying high manganese non-ferromagnetic amorphous steel alloys and related method of using and making articles (e.g., systems, structures, components) of the same.

The steps discussed throughout this document may be performed in various orders and/or with modified procedures or compositions suitable to a given application.

In one embodiment, the present invention features an Fe-based non-ferromagnetic amorphous steel alloy comprised substantially or entirely of a composition represented by the formula: $(Fe_{1-a-b-c}Mn_aCr_bMo_c)_{100-d-e-f}Zr_dNb_eB_f$, wherein a, b, c, d, e, and f respectively satisfy the relations: $0.29 \geqq a \geqq 0.2$, $0.1 \geqq b \geqq 0$, $0.05 \geqq c \geqq 0$, $10 \geqq d \geqq 2$, $6 \geqq e \geqq 0$, $24 \geqq f \geqq 13$.

In a second embodiment, the present invention features an Fe-based amorphous steel alloy comprised substantially of a composition represented by the formula: $(Fe_{1-a-b-c}Mn_aCr_bMo_c)_{100-d-e-f}Zr_dNb_eB_f$, wherein a, b, c, d, e, and f respectively satisfy the relations $0.29 \geqq a \geqq 0.2$, $0.1 \geqq b \geqq 0$, $0.05 \geqq c \geqq 0$, $10 \geqq d \geqq 2$, $6 \geqq e \geqq 0$, $24 \geqq f \geqq 13$, and wherein the alloy has a critical cooling rate of less than about 1,000° C./sec.

In a third embodiment, the present invention features an Fe-based amorphous steel alloy comprised substantially of a composition represented by the formula: $(Fe_{1-a-b-c}Mn_aCr_bMo_c)_{100-d-e-f}Zr_dNb_eB_f$, wherein a, b, c, d, e, and f respectively satisfy the relations $0.29 \geqq a \geqq 0.2$, $0.1b \geqq 0$, $0.05 \geqq c \geqq 0$, $10 \geqq d \geqq 2$, $6 \geqq e \geqq 0$, $24 \geqq f \geqq 13$, and wherein the alloy is processable into amorphous sample of at least about 0.1 mm in thickness in its minimum dimension.

In a fourth embodiment, the present invention features an Fe-based non-ferromagnetic amorphous steel alloy comprised substantially or entirely of a composition represented by the formula: $Fe_{100-a-b-c-d-e}Mn_aMo_bCr_cB_dC_e$, wherein a, b, c, d, and e respectively satisfy the relations: $13 \geqq a \geqq 8$, $17 \geqq b \geqq 12$, $5 \geqq c \geqq 0$, $7 \geqq d \geqq 4$, $17 \geqq e \geqq 13$ (these subscript values indicating the atomic percent amounts of the constituent elements of the composition).

In a fifth embodiment, the present invention features an Fe-based amorphous steel alloy comprised substantially of a composition represented by the formula: $Fe_{100-a-b-c-d-e}Mn_aMo_bCr_cB_dC_e$, wherein a, b, c, d, and e respectively satisfy the relations $13 \geqq a \geqq 8$, $17 \geqq b \geqq 12$, $5 \geqq c \geqq 0$, $7 \geqq d4$, $17 \geqq e \geqq 13$, these subscript values indicating the atomic percent amounts of the constituent elements of the composition; and wherein the alloy has a critical cooling rate of less than about 1,000° C./sec.

In a sixth embodiment, the present invention features an Fe-based amorphous steel alloy comprised substantially of a composition represented by the formula: $Fe_{100-a-b-c-d-e}Mn_aMo_bCr_cB_dC_e$, wherein a, b, c, d, and e respectively satisfy the relations $13 \geqq a \geqq 8$, $17 \geqq b \geqq 12$, $5 \geqq c \geqq 0$, $7 \geqq d \geqq 4$, $17 \geqq e \geqq 13$, these subscript values indicating the atomic percent amounts of the constituent, elements of the composition; and wherein the alloy is processable into bulk amorphous sample of at least about 0.1 mm in thickness in its minimum dimension.

In a seventh embodiment, the present invention features an Fe-based non-ferromagnetic amorphous steel alloy comprised substantially or entirely of a composition represented by the formula: $Fe_{100-a-b-c-d-e-f}Mn_aMo_bCr_cB_dP_eC_f$, wherein a, b, c, d, e, and f respectively satisfy the relations: $15 \geqq a5$, $14 \geqq b \geqq 8$, $10 \geqq c \geqq 4$, $8 \geqq d \geqq 0$, $12 \geqq e \geqq 5$, $16 \geqq f \geqq 4$ (these subscript values indicating the atomic percent amounts of the constituent elements of the composition).

In an eighth embodiment, the present invention features an Fe-based amorphous steel alloy comprised substantially of a composition having the formula: $Fe_{100-a-b-c-d-e-f}Mn_aMo_bCr_cB_dP_eC_f$, wherein a, b, c, d, e, and f respectively satisfy the relations $15 \geqq a \geqq 5$, $14 \geqq b \geqq \geqq 8$, $10 \geqq c \geqq 4$, $8 \geqq d \geqq 0$, $12 \geqq e \geqq 5$, $16 \geqq f \geqq 4$, these subscript values indicating the atomic percent amounts of the constituent elements-of the composition; and wherein the alloy has a critical cooling rate of less than about 1,000° C/sec.

In a ninth embodiment, the present invention features an Fe-based amorphous steel alloy comprised substantially of a composition having the formula: $Fe_{100-a-b-c-d-e-f}Mn_aMo_bCr_cB_dP_eC_f$, wherein a, b, c, d, e, and f respectively satisfy the relations $15 \geqq a \geqq 5$, $14 \geqq b \geqq 8$, $10 \geqq c \geqq 4$, $8 \geqq d \geqq 0$, $12 \geqq e \geqq 5$, $16 \geqq f \geqq 4$, these subscript values indicating the atomic percent amounts of the constituent elements of the composition; and wherein the alloy is processable into bulk amorphous sample of at least about 0.1 mm in thickness in its minimum dimension.

In a tenth embodiment, the present invention features method of producing a feedstock of the Fe-based alloy comprising the steps of: (a) melting at least substantially all elemental components together of the Fe-based alloy except Mn (preferably in an arc furnace) so as to provide at least one Mn-free ingot; (b) melting at least one the Mn-free ingot together with Mn forming at least one final ingot; and (c) bulk-solidifying at least one the final ingot through conventional mold casting.

In an eleventh embodiment, the present invention features method of producing "homogeneously alloyed" feedstock for the Fe-based alloy, which comprises the steps: (a) melting at least substantially all elemental components together of the Fe-based alloy except Mn to provide at least one Mn-free ingot; and (b) melting at least one the Mn-free ingot together with Mn forming at least one final ingot.

In a twelfth embodiment, the present invention features method of producing a feedstock of the Fe-based alloy comprising the steps of: (a) melting substantially all elemental components together of the Fe-based alloy except Mn (preferably in an arc furnace) to provide at least one Mn-free ingot; (b) melting Mn obtaining at least one clean Mn; (c) melting at least one the Mn-free ingot together with at least one the clean Mn forming a final ingot; and (d) bulk-solidifying at least one the final ingot through mold casting.

In a thirteenth embodiment, the present invention features method of producing "homogeneously alloyed" feedstock for the Fe-based alloy, which comprises the steps: (a) melting substantially all elemental components together of the Fe-based alloy except Mn to provide at least one Mn-free ingot; (b) melting Mn obtaining at least one clean Mn; and (c) melting at least one the Mn-free ingot together with at least one the clean Mn forming a final ingot.

In a fourteenth embodiment, the present invention features method of producing the Fe-based alloy comprising the steps of: (a) mixing Fe, C, Mo, Cr, and B forming a mixture; (b) pressing the mixture into at least one mass; (c) melting at least one the mass in a suitable furnace forming at least one preliminary ingot; (d) melting at least one the preliminary ingot with Mn to form at least one final ingot; and (e) bulk-solidifying at least one the final ingot through mold casting.

In a fifthteenth embodiment, the present invention features a method of producing "homogeneously alloyed" feedstock for the Fe-based alloy, which comprises the steps: (a) mixing Fe, C, Mo, Cr, and B forming a mixture; (b) pressing the mixture into at least one mass; (c) melting at least one the mass in a furnace forming at least one preliminary ingot; and (d) melting at least one the preliminary ingot with Mn to form at least one final ingot.

In a sixteenth embodiment, the present invention features a method of producing the Fe-based alloy comprising the steps of: (a) mixing Fe, C, Mo, Cr, B, and P forming a mixture; (b) pressing the mixture into at least one mass; (c) melting at least one the mass in a furnace forming at least one preliminary ingot; (d) melting at least one the preliminary ingot with Mn to form at least one final ingot; and (e) bulk-solidifying at least one the final ingot through mold casting.

In a seventeenth embodiment, the present invention features a method of producing "homogeneously alloyed" feedstock for the Fe-based alloy, which comprises the steps: (a) mixing Fe, C, Mo, Cr, B, and P forming a mixture; (b) pressing the mixture into at least one mass; (c) melting at least one the mass in a furnace forming at least one preliminary ingot; and (d) melting at least one the preliminary ingot with Mn to form at least one final ingot.

The present invention provides both the non-ferromagnetic properties at ambient temperature as well as useful mechanical attributes. The present invention is a new class of ferrous-based bulk-solidifying amorphous metal alloys for non-ferromagnetic structural applications. Thus, the present invention alloys exhibit magnetic transition temperatures below the ambient, mechanical strengths and hardness superior to conventional steel alloys, and good corrosion resistance.

The present invention alloys, for example, contain either high manganese addition or high manganese in combination with high molybdenum and carbon additions. The present invention alloys exhibit high reduced glass temperatures and large supercooled liquid regions comparable to conventional processable magnetic ferrous-based bulk metallic glasses. Furthermore, since the synthesis-processing methods employed by the present invention do not involve any special materials handling procedures, they are directly adaptable to low-cost industrial processing technology.

Metalloids tend to restore the Curie point that is otherwise suppressed by adding refractory metals to amorphous ferrous-based alloys. The addition of manganese is very effective in suppressing ferromagnetism [5]. For the present invention alloys, the addition of about 10 atomic percent or higher manganese content reduces the Curie point to below ambient temperatures, as measured by using a Quantum Design MPMS system. The Curie point and spin-glass transition temperatures are observed to be below about −100° C. The present invention reveals that the addition of manganese to ferrous-based multi-component alloys is largely responsible for the high fluid viscosity observed. High fluid viscosity enhances the processability of amorphous alloys.

Compositions of the present invention reveal that when molybdenum and chromium are added they provide the alloys with high hardness and good corrosion resistance. Accordingly, the present invention alloys contain comparable or significantly higher molybdenum content than conventional steel alloys. Preliminary measurements in an embodiment of the present invention show microhardness in the range of about 1200–1600 DPN and tensile fracture strengths of at least about 3000 MPa; values that far exceed those reported for high-strength steel alloys. Preliminary corrosion tests in acidic pH:6 solution show very good corrosion resistance properties characterized by a very low passivating current of about $8\times10^{-7}$ to $1\times10^{-6}$ A/cm$^2$, a large passive region of about 0.8 V, and a pitting potential of about +0.5 V or greater. The present potentiodynamic polarization characteristics are comparable to the best results reported on conventional amorphous ferrous and nickel alloys [6].

BRIEF DESCRIPTION OF THE DRAWINGS

The foregoing and other objects, features and advantages of the present invention, as well as the invention itself, will be more fully understood from the following description of preferred embodiments, when read together with the accompanying drawings in which.

DETAILED DESCRIPTION OF THE INVENTION

The present invention provides a novel non-ferromagnetic glassy alloy at ambient temperature and related method of using and making articles (e.g., systems, structures, components) of the same.

In an embodiment of the present invention, alloy ingots are prepared by melting mixtures of good purity elements in an arc furnace or induction furnace. In order to produce homogeneous ingots of the complex alloys that contained manganese, refractory metals, and metalloids particularly carbon, it was found necessary to perform the alloying in two separate stages (or more). For alloys that contain iron, manganese, and boron as the principal components, a mixture of all the elemental components except manganese was first melted together in an arc furnace. The ingot obtained was then combined with manganese and melted together to form the final ingot. For stage 2 alloying, it was found preferable to use clean manganese obtained by first premelting manganese pieces in an arc furnace.

In the case of alloys that contain iron, manganese, molybdenum, and carbon as the principal components, iron granules, graphite powders (about −200 mesh), and molybdenum powders (about −200 to −375 mesh) plus chromium, boron, and phosphorous pieces were mixed well together and pressed into a disk or cylinder or any given mass. Alternatively, small graphite pieces in the place of graphite powders can also be used. The mass is melted in an arc furnace or induction furnace to form an ingot. The ingot obtained was then combined with manganese and melted together to form the final ingot.

Figure 1:
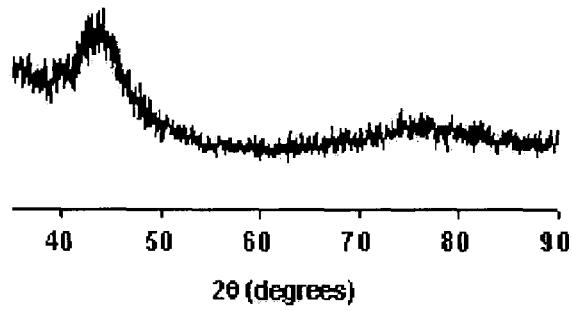
FIG. 1 illustrates an x-ray diffraction pattern from exemplary sample pieces of total mass about 1 gm obtained by crushing a 4 mm-diameter as-cast rod of the present invention MnMoC-class amorphous ferrous alloy.
Figure 2:
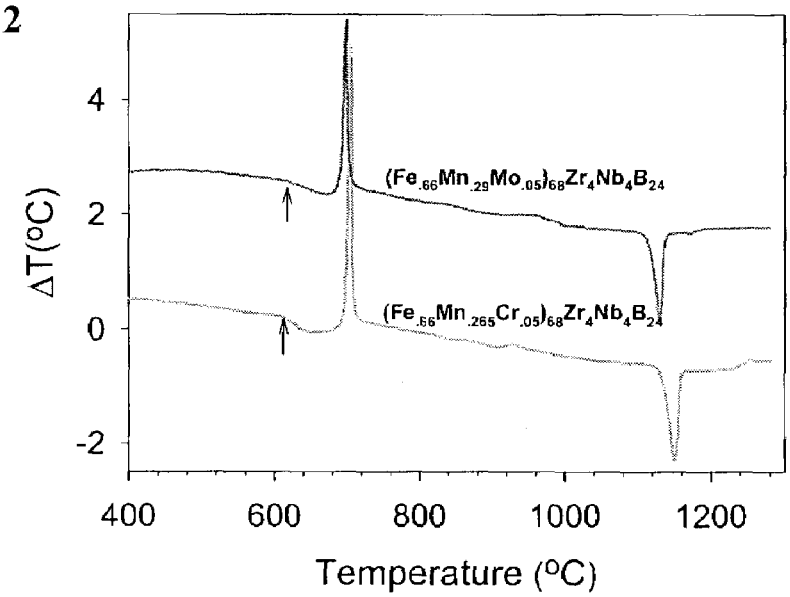
FIG. 2 illustrates a differential thermal analysis plots obtained at scanning rate of 10° C./min showing glass transition (indicated by arrows), crystallization, and melting in two present invention exemplary amorphous steel alloys of the MnB class.
Figure 3:
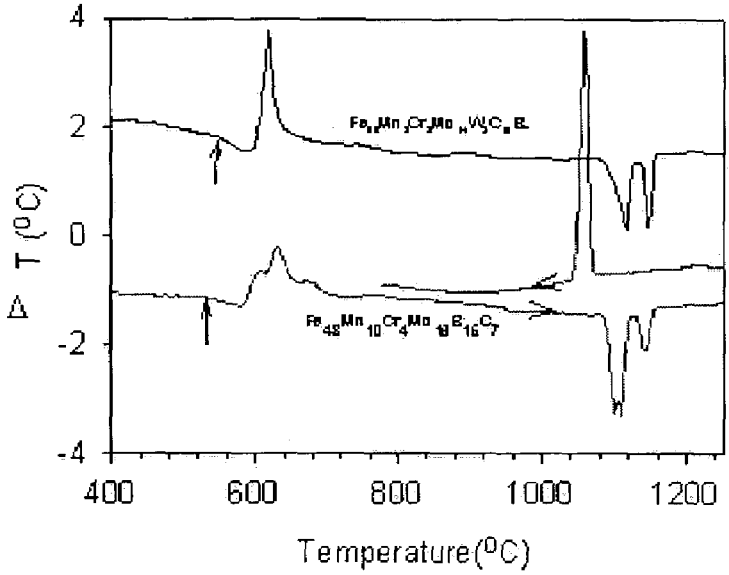
FIG. 3 illustrates differential thermal analysis plots obtained at scanning rate of 10° C./min showing glass transition (indicated by arrows), crystallization, and melting in two exemplary amorphous steel alloys of the MnMoC class. The partial trace is obtained upon cooling.

Next, regarding the glass formability and processability, bulk-solidifying samples can be obtained using a conventional copper mold casting, for example, or other suitable methods. In one instance, by injecting the melt into a cylinder-shaped cavity inside a copper block (preferably a water-cooled copper block). Thermal transformation data were acquired using a Differential Thermal Analyzer (DTA). It was found that the designed ferrous-based alloys exhibit a reduced glass temperature $T_{rg}$ in the range of about 0.59–0.63 and large supercooled liquid region $\Delta T_x$ in the range of about 45–100° C. Moreover, some of the alloy ingots hardly changes shape upon melting and are presumed to be extremely viscous in the molten state. In the instant exemplary embodiment, the present invention amorphous steel alloys were cast into cylinder-shaped amorphous rods with diameters reaching about 4 millimeter (mm). Various ranges of thickness, size, length, and volume are possible. For example, in some embodiments the present invention alloys are processable into bulk amorphous samples with a range thickness of about 0.1 mm or greater. The amorphous nature of the rods is confirmed by x-ray and electron diffraction as well as thermal analysis (as shown in FIGS. 1, 2, and 3). Given the high $T_{rg}$ and large $\Delta T_x$ measured in some of the alloys, the utilization of high-pressure casting methods and/or other emphasized methods produce thicker samples, including thick plates or as desired.

The present alloys may be devitrified to form amorphous-crystalline microstructures, or blended with other ductile phases during solidification of the amorphous alloys to form composite materials, which can result in strong hard products with improved ductility for structural applications.

Accordingly, the present invention amorphous steel alloys outperform current steel alloys in many application areas. Some products and services of which the present invention can be implemented includes, but is not limited thereto 1) ship, submarine (e.g., watercrafts), and vehicle (land-craft and aircraft) frames and parts, 2) building structures, 3) armor penetrators, armor penetrating projectiles or kinetic energy projectiles, 4) protection armors, armor composites, or laminate armor, 5) engineering, construction, and medical materials and tools and devices, 6) corrosion and wear-resistant coatings, 7) cell phone and personal digital assistant (PDA) casings, housings and components, 8) electronics and computer casings, housings, and components, 9) magnetic levitation rails and propulsion system, 10) cable armor, 11) hybrid hull of ships, wherein "metallic" portions of the hull could be replaced with steel having a hardened non-magnetic coating according to the present invention, 12) composite power shaft, 13) actuators and other utilization that require the combination of specific properties realizable by the present invention amorphous steel alloys.

The U.S. patents listed below are illustrative applications for the present invention method of using and fabrication, and are hereby incorporated by reference herein in their entirety:

U.S. Pat. No. 4,676,168 to Cotton et al. entitled "Magnetic Assemblies for Minesweeping or Ship Degaussing;"

U.S. Pat. No. 5,820,963 to Lu et al. entitled "Method of Manufacturing a Thin Film Magnetic Recording Medium having Low MrT Value and High Coercivity;"

U.S. Pat. No. 5,866,254 to Peker et al. entitled "Amorphous metal/reinforcement Composite Material;"

U.S. Pat. No. 6,446,558 to Peker et al. entitled "Shaped-Charge Projectile having an Amorphous-Matrix Composite Shaped-charge Filter;"

U.S. Pat. No. 5,896,642 to Peker et al. entitled "Die-formed Amorphous Metallic Articles and their Fabrication;"

U.S. Pat. No. 5,797,443 to Lin, Johnson, and Peker entitled "Method of Casting Articles of a Bulk-Solidifying Amorphous Alloy;"

U.S. Pat. No. 4,061,815 to Poole entitled "Novel Compositions;"

U.S. Pat. No. 4,353,305 to Moreau, et al. entitled "Kinetic-energy Projectile;"

U.S. Pat. No. 5,228,349 to Gee et al. entitled "Composite Power Shaft with Intrinsic Parameter Measurability;"

U.S. Pat. No. 5,728,968 to Buzzett et al. entitled "Armor Penetrating Projectile;"

U.S. Pat. No. 5,732,771 to Moore entitled "Protective Sheath for Protecting and Separating a Plurality for Insulated Cable Conductors for an Underground Well;"

U.S. Pat. No. 5,868,077 to Kuznetsov entitled "Method and Apparatus for Use of Alternating Current in Primary Suspension Magnets for Electrodynamic Guidance with Superconducting Fields;"

U.S. Pat. No. 6,357,332 to Vecchio entitled "Process for Making Metallic/intermetallic Composite Laminate Material and Materials so Produced Especially for Use in Lightweight Armor;"

U.S. Pat. No. 6,505,571 to Critchfield et al. entitled "Hybrid Hull Construction for Marine Vessels;"

U.S. Pat. No. 6,515,382 to Ullakko entitled "Actuators and Apparatus;"

For some embodiments of the present invention, two classes of non-ferromagnetic ferrous-based bulk amorphous metal alloys are obtained. The alloys in the subject two classes contain about 50 atomic % of iron. First, a high-manganese class (labeled MnB) contains manganese and boron as the principal alloying components. Second, a high manganese-high molybdenum class (labeled MnMoC) contains manganese, molybdenum, and carbon as the principal alloying components. For illustration purposes, more than fifty compositions of each of the two classes are selected for testing glass formability.

First, regarding the high-manganese class, the MnB-class amorphous steel alloys are given by the formula (in atomic percent) as follows:

$$(Fe_{100-a-b-c}Mn_aCr_bMo_c)_{100-x-y-z}Zr_xNb_yB_z$$

where $0.29 \geqq a \geqq 0.2$, $0.1 \geqq b \geqq 0$, $0.05 \geqq c \geqq 0$, $10 \geqq x \geqq 2$, $6 \geqq y \geqq 0$, $24 \geqq z \geqq 13$.

These alloys are found to exhibit reduced glass temperature $T_{rg}$ of about 0.6–0.63 (or greater) and supercooled liquid region $\Delta T_x$ of about 60–100° C. (or greater). Results from differential thermal analysis (DTA) on two alloys with $T_{rg}$~0.63 are shown in FIG. 2. Following the correlation between sample thickness, reduced glass temperature, and supercooled liquid region observed in other bulk metallic glasses, some of the invention alloys in an embodiment are processable into bulk amorphous samples with maximum thickness of at least about 5 mm. Because of the high viscosity, the melt must be heated to temperatures considerably higher than the liquidus temperature in order to provide the fluidity needed in copper mode casting. As a result, the effectiveness in heat removal is significantly reduced, which limits the diameter of the amorphous rods to only about 2 mm in this embodiment. Various ranges of thickness are possible. For example, in some embodiments the present invention alloys are processable into bulk amorphous samples with a range thickness of about 0.1 mm or higher. In addition, high-pressure squeeze casting exploits the full potential of these alloys as processable amorphous high-manganese steel alloys. Several atomic percent of carbon and/or silicon have also been substituted for boron in the above alloys. Nickel has also been used to partially substitute iron. The substituted alloys also exhibit $T_{rg}$ of about 0.6 and large supercooled liquid region of at least about 60° C. A number of typical amorphous steel alloys of the MnB class together with their $T_g$, $\Delta T_x$, and $T_{rg}$ values are given in Table 1. Table 1 summarizes results obtained from DTA scan of high-manganese (MnB) amorphous steel alloys of one exemplary embodiment. These exemplary embodiments are set forth for the purpose of illustration only and are not intended in any way to limit the practice of the invention.

TABLE 1

High-Manganese (MnB) Amorphous Steel Alloys

| | |
|---|---|
| $(Fe_{70}Mn_{20}Cr_{10})_{68}Zr_7Nb_3B_{22}$ | $T_g$ = 595° C.; $\Delta T_x$ = 75° C.; $T_{rg}$ = 0.61 |
| $(Fe_{70}Mn_{25}Cr_5)_{68}Zr_7Nb_3B_{22}$ | $T_g$ = 613° C.; $\Delta T_x$ = 78° C.; $T_{rg}$ = 0.61 |
| $(Fe_{70}Mn_{26.5}Cr_5)_{68}Zr_{10}C_3B_{19}$ | $T_g$ = 580° C.; $\Delta T_x$ = 70° C.; $T_{rg}$ = 0.60 |
| $(Fe_{70}Mn_{26.5}Cr_5)_{68}Zr_7Nb_3B_{22}$ | $T_g$ = 613° C.; $\Delta T_x$ = 78° C.; $T_{rg}$ = 0.61 |
| $(Fe_{70}Mn_{26.5}Cr_5)_{70}Zr_6Nb_2B_{22}$ | $T_g$ = 607° C.; $\Delta T_x$ = 78° C.; $T_{rg}$ = 0.62 |
| $(Fe_{70}Mn_{26.5}Cr_5)_{70}Zr_4Nb_4B_{22}$ | $T_g$ = 595° C.; $\Delta T_x$ = 78° C.; $T_{rg}$ = 0.62 |
| $(Fe_{65}Mn_{26}Cr_5Mo_4)_{70}Zr_4Nb_4B_{22}$ | $T_g$ = 571° C.; $\Delta T_x$ = 59° C.; $T_{rg}$ = 0.60 |
| $(Fe_{70}Mn_{26.5}Cr_5)_{68}Zr_6Nb_6B_{20}$ | $T_g$ = 595° C.; $\Delta T_x$ = 94° C.; $T_{rg}$ = 0.60 |
| $(Fe_{70}Mn_{26.5}Cr_5)_{68}Zr_6Nb_2B_{24}$ | $T_g$ = 591° C.; $\Delta T_x$ = 78° C.; $T_{rg}$ = 0.61 |
| $(Fe_{70}Mn_{26.5}Cr_5)_{68}Zr_4Nb_4B_{24}$ | $T_g$ = 613° C.; $\Delta T_x$ = 85° C.; $T_{rg}$ = 0.63 |
| $(Fe_{70}Mn_{26.5}Cr_5)_{68}Zr_5Nb_3B_{24}$ | $T_g$ = 602° C.; $\Delta T_x$ = 90° C.; $T_{rg}$ = 0.62 |
| $(Fe_{65}Mn_{26}Cr_5Mo_4)_{68}Zr_4Nb_4B_{24}$ | $T_g$ = 585° C.; $\Delta T_x$ = 90° C.; $T_{rg}$ = 0.62 |
| $(Fe_{66}Mn_{29}Mo_5)_{68}Zr_4Nb_4B_{24}$ | $T_g$ = 605° C.; $\Delta T_x$ = 87° C.; $T_{rg}$ = 0.63 |
| $(Fe_{66}Mn_{29}Cr_5)_{68}Zr_4Nb_4B_{24}$ | $T_g$ = 600° C.; $\Delta T_x$ = 100° C.; $T_{rg}$ = 0.62 |
| $(Fe_{70}Mn_{26.5}Cr_5)_{68}Zr_4Ti_4B_{24}$ | $T_g$ = 560° C.; $\Delta T_x$ = 60° C.; $T_{rg}$ = 0.59 |
| $(Fe_{66}Mn_{29}Mo_5)_{68}Zr_4Nb_4B_{20}Si_4$ | $T_g$ ~590° C.; $\Delta T_x$ = 72° C.; $T_{rg}$ ~0.63 |
| $(Fe_{66}Mn_{29}Mo_5)_{68}Zr_4Nb_4B_{22}Si_2$ | $T_g$ ~595° C.; $\Delta T_x$ = 75° C.; $T_{rg}$ ~0.63 |
| $(Fe_{70}Mn_{25}Cr_5)_{68}Zr_7Nb_3C_3B_{13}Si_6$ | $T_g$ = 573° C.; $\Delta T_x$ = 90° C.; $T_{rg}$ = 0.60 |
| $(Fe_{60}Mn_{25}Cr_5Ni_{10})_{68}Zr_7Nb_3B_{22}$ | $T_g$ = 572° C.; $\Delta T_x$ = 75° C.; $T_{rg}$ = 0.59 |
| $(Fe_{70}Mn_{26.5}Cr_5)_{68}Zr_{10}C_3B_{19}$ | $T_g$ = 580° C.; $\Delta T_x$ = 72° C.; $T_{rg}$ = 0.60 |

Figure 4:
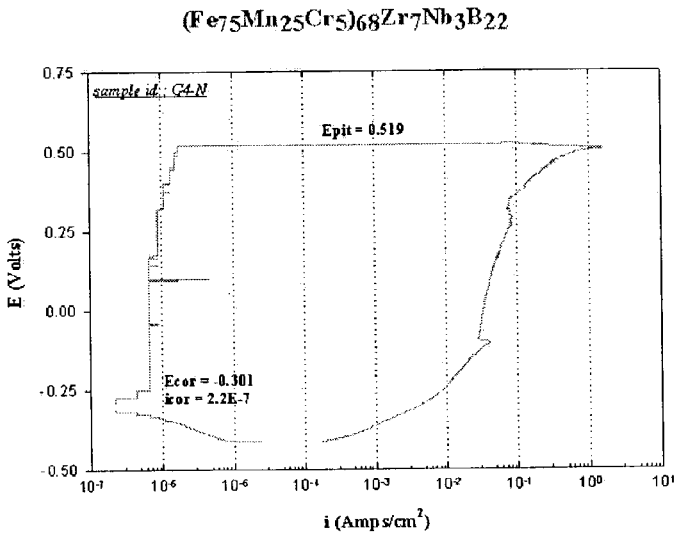
FIG. 4 illustrates a potentiodynamic polarization trace obtained on one of the present invention exemplary MnB-class amorphous alloy sample immersed in 0.6M NaCl pH:6.001 solution.

FIG. 4 shows the potentiodynamic polarization trace obtained on one of these alloys immersed in 0.6M NaCl pH:6.001 solution. The low passivating current, large passive region, and high pitting potential are noted.

In an embodiment of the high-manganese class, the MnB-class amorphous steel alloys, the composition region of these alloys can be given by the formula (in atomic percent) as follows:

$$(Fe, Ni)_a(Mn, Cr, Mo, Zr, Nb)_b(B, Si, C)_c$$

where, $43 \geqq a \geqq 50$, $28 \geqq b \geqq 36$, $18 \geqq c \geqq 25$, and the sum of a, b, and c is 100 and under the following constraints that Fe content is at least about 40%, Mn content is at least about 13%, Zr content is at least about 3%, and B content is at least about 12% in the overall alloy composition. These alloys are typically non-ferromagnetic and have low critical cooling rates of less than about 1,000° C./sec and castable into bulk objects of minimum dimension of at least about 0.5/mm. These alloys also have high $T_{rg}$ of about 0.60 or higher, and high $\Delta T_x$ of about 50° C. or greater.

Next, regarding the High Manganese-High Molybdenum Class, the MnMoC-class amorphous steel alloys are given by the formula (in atomic percent) as follows:

$$Fe_{100-a-b-c-d-e}Mn_aMo_bCr_cB_dC_e$$

where 13≧a≧8, 17≧b≧12, 5≧c≧0, 7≧d≧4, 17≧e≧13.

Figure 5:
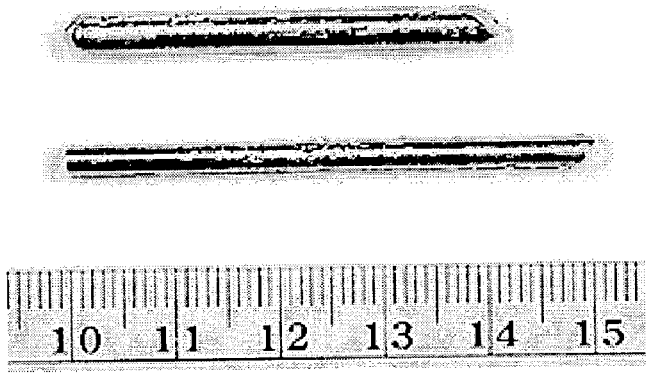
FIG. 5 illustrate segments of two exemplary amorphous rods, one 3 mm ($Fe_{50}Mn_{10}Mo_{14}Cr_4C_{15}B_7$, bottom sample) in diameter and one 4 mm ($Fe_{52}Mn_{10}Mo_{14}Cr_4C_{15}B_6$, top sample) in diameter, obtained by injection casting.

These alloys are found to exhibit a glass temperature $T_g$ of about 530–550° C. (or greater), $T_{rg}$ ~0.59–0.61 (or greater) and supercooled liquid region $\Delta T_x$ of about 45–55° C. (or greater). DTA scans obtained from typical samples are shown in FIG. 3. Some alloys also contain one to three atomic percent of Ga, V, and W additions. Various ranges of thickness are possible. For example, in some embodiments the present invention alloys are processable into bulk amorphous samples with a range thickness of about 0.1 mm or greater. In an embodiment, despite the lower $T_{rg}$ and smaller $\Delta T_x$ in comparison to the MnB alloys, the MnMoC alloys can be readily cast into about 4 mm-diameter rods. A camera photo of two injection-cast amorphous rods is displayed in FIG. 5. The alloy melts are observed to be much less viscous than the MnB-alloy melts. Upon further alloying, thicker samples can be achieved. A variety of embodiments representing a number of typical amorphous steel alloys of the MnMoC class together with the sample thickness are listed in Table 2. Table 2 lists representative high manganese-high molybdenum (MnMoC) amorphous steel alloys and the maximum diameter of the bulk-solidifying amorphous cylinder-shaped samples obtained. At present, it is found in one embodiment that alloys containing as low as about 19 atomic % combined (B,C) metalloid content can be bulk solidified into about 3 mm-diameter amorphous rods. These exemplary embodiments are set forth for the purpose of illustration only and are not intended in any way to limit the practice of the invention.

TABLE 2

| High Manganese-High Molybdenum (MnMoC) Amorphous Steel Alloys | |
|---|---|
| $Fe_{54}Mn_{10}Mo_{14}B_7C_{15}$ | 3 mm |
| $Fe_{49}Mn_8Mo_{13}Cr_5W_3B_7C_{15}$ | 2 mm |
| $Fe_{49}Mn_{10}Mo_{14}Cr_4B_7C_{16}$ | 2 mm |
| $Fe_{49}Mn_{10}Mo_{14}Cr_4Ga_1B_7C_{15}$ | 2 mm |
| $Fe_{46}Mn_{10}Mo_{16}Cr_4Ga_2B_7C_{15}$ | 2 mm |
| $Fe_{49}Mn_{10}Mo_{14}Cr_4V_1B_7C_{15}$ | 3 mm |
| $Fe_{49}Mn_{10}Mo_{14}Cr_4W_1B_7C_{15}$ | 3 mm |
| $Fe_{51}Mn_{10}Mo_{13}Cr_4B_7C_{15}$ | 3 mm |
| $Fe_{51}Mn_{10}Mo_{14}Cr_4B_6C_{15}$ | 4 mm |
| $Fe_{52}Mn_{10}Mo_{14}Cr_4B_6C_{14}$ | 4 mm |
| $Fe_{49}Mn_{10}Mo_{14}Cr_4W_1B_6C_{16}$ | 4 mm |
| $Fe_{49}Mn_{10}Mo_{15}Cr_4B_6C_{16}$ | 4 mm |
| $Fe_{52}Mn_{10}Mo_{14}Cr_4B_5C_{15}$ | 3 mm |
| $Fe_{53}Mn_{10}Mo_{14}Cr_4B_{5.5}C_{13.5}$ | 3 mm |
| $Fe_{50}Mn_{10}Mo_{14}Cr_4B_5C_{17}$ | 3 mm |
| $Fe_{48}Mn_{10}Mo_{16}Cr_4B_7C_{15}$ | 3 mm |
| $Fe_{50}Mn_{10}Mo_{14}Cr_4B_7C_{15}$ | 3 mm |
| $Fe_{50}Mn_8Mo_{14}Cr_3W_3B_7C_{15}$ | 3 mm |
| $Fe_{48}Mn_{10}Mo_{13}Cr_4W_3B_7C_{15}$ | 2 mm |
| $Fe_{49}Mn_{10}Mo_{13}Cr_3W_3B_7C_{15}$ | 2 mm |
| $Fe_{47}Mn_{10}Mo_{18}Cr_3B_7C_{15}$ | 2 mm |
| $Fe_{48}Mn_{12}Mo_{14}Cr_4C_{15}B_7$ | 1.5 mm |

Figure 6:
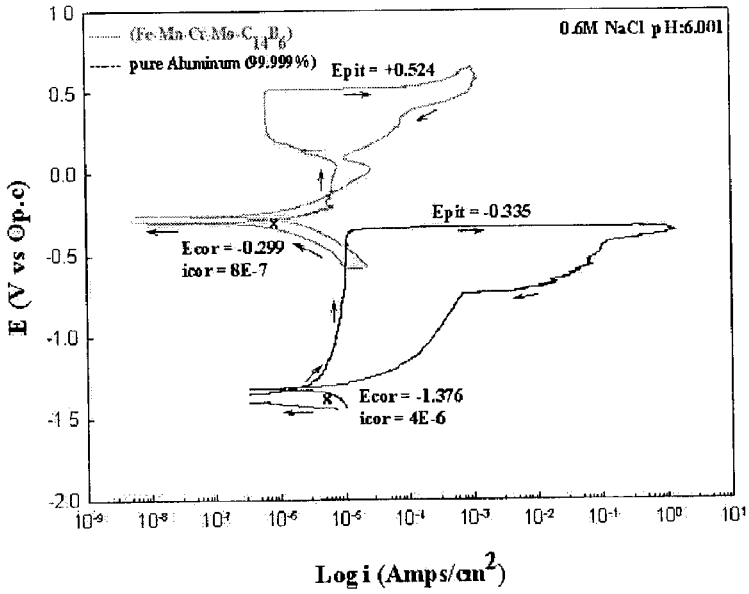
FIG. 6 illustrate a typical potentiodynamic polarization trace obtained on exemplary 3 mm-diameter samples of amorphous $Fe_{52}Mn_{10}Mo_{14}Cr_4B_6C_{14}$.

FIG. 6 shows a typical potentiodynamic polarization trace obtained on approximately 3 mm-diameter samples of amorphous $Fe_{52}Mn_{10}Mo_{14}Cr_4B_6C_{14}$ immersed in 0.6M NaCl pH:6.001 solution. The low passivating current, large passive region, and high pitting potential are noted.

In an embodiment of the high manganese-high molybdenum class, the MnMoC-class amorphous steel alloys, the composition of these alloys are given by the formula (in atomic percent) as follows:

$$(Fe)_a(Mn, Cr, Mo)_b(B, C)_c$$

where, 45≧a≧55, 23≧b≧33, 18≧c≧24, and the sum of a, b, and c is 100 and under the following constraints that Mo content is at least about 12%, Mn content is at least about 7%, Cr content is at least about 3%, C content is at least about 13%, and B content is at least about 4% in the overall alloy composition. These alloys are typically non-ferromagnetic and have low critical cooling rates of less than about 1,000° C./sec and castable into bulk objects of minimum dimension of at least about 0.5/mm. These alloys also have high Trg of about 0.60 or greater, and high $\Delta T_x$ of about 50° C. or greater.

Moreover, in another embodiment, phosphorus has also been incorporated into the MnMoC-alloys to modify the metalloid content, with the goal of further enhancing the corrosion resistance. Various ranges of thickness are possible. For example, in some embodiments the present invention alloys are processable into bulk amorphous samples with a range thickness of about 0.1 mm or greater. In one embodiment, bulk-solidified non-ferromagnetic amorphous samples of up to about 3 mm in diameter was be obtained. The general formula (in atomic percent) of the latter alloys are given as:

$$Fe_{100-a-b-c-d-e-f}Mn_aMo_bCr_cB_dP_eC_f$$

where 15≧a≧5, 14≧b≧8, 10≧c≧4, 8≧d≧0, 12≧e≧5, 16≧f≧4.

These alloys are found to exhibit a glass temperature $T_g$ of about 480–500° C. (or greater), $T_{rg}$ of about 0.60 (or greater) and supercooled liquid region $\Delta T_x$ of about 45–50° C. (or greater). A variety of embodiments representing a number of typical amorphous steel alloys of this phosphorus-containing MnMoC class together with the sample thickness are listed in Table 3. Table 3 lists representative MnMoC amorphous steel alloys that also contain phosphorus and the diameter of the bulk samples obtained.

| | |
|---|---|
| $Fe_{48}Mn_{10}Mo_{13}Cr_4W_3C_{16}P_6$ | 2 mm |
| $Fe_{52}Mn_{10}Cr_4Mo_{14}C_4P_{12}B_4$ | 2 mm |
| $Fe_{58}Mn_{10}Cr_4Mo_8C_4P_{12}B_4$ | 2 mm |
| $Fe_{52}Mn_{10}Cr_6Mo_{12}C_4P_{12}B_4$ | 2 mm |
| $Fe_{52}Mn_{10}Mo_{10}Cr_8C_4P_{12}B_4$ | 2 mm |
| $Fe_{53}Mn_{10}Mo_{12}Cr_4C_7P_7B_7$ | 3 mm |
| $Fe_{53}Mn_{10}Mo_{12}Cr_4C_7P_9B_5$ | 2 mm |
| $Fe_{58}Mn_5Cr_4Mo_{12}C_7P_7B_7$ | 2 mm |
| $Fe_{48}Mn_{15}Cr_4Mo_{12}C_7P_7B_7$ | 2 mm |
| $Fe_{48}Mn_{10}Cr_4Mo_{12}C_8P_5B_8$ | 1.5 mm |

In an embodiment of the group containing P, amorphous steel alloys are given by the formula (in atomic percent) as follows:

$$(Fe)_a(Mn, Cr, Mo)_b(B, P, C)_c$$

where, 47≧a≧59, 20≧b≧32, 19≧c≧23, and the sum of a, b, and c is 100 and under the following constraints that Mo content is at least 7%, Mn content is at least about 4%, Cr content is at least about 3%, C content is at least about 3%, P content is at least about 4%, and B content is at least about 4% in the overall alloy composition. These alloys are typically non-ferromagnetic and have low critical cooling rates of less than about 1,000° C./sec and castable into bulk objects of minimum dimension of at least about 0.5/mm. These alloys also have high $T_{rg}$ of about 0.60 or greater, and high $\Delta T_x$ of about 50° C. or greater.

The following U.S. patents are hereby incorporated by reference herein in their entirety:

| | |
|---|---|
| U.S. Pat. No. 5,738,733 | Inoue A. et al. |
| U.S. Pat. No. 5,961,745 | Inoue A. et al. |
| U.S. Pat. No. 5,976,274 | Inoue A. et al. |
| U.S. Pat. No. 6,172,589 | Fujita K. et al. |
| U.S. Pat. No. 6,280,536 | Inoue A. et al. |
| U.S. Pat. No. 6,284,061 | Inoue A. et al. |
| U.S. Pat. No. 5,626,691 | Li, Poon, and Shiflet |
| U.S. Pat. No. 6,057,766 | O'Handley et al. |

The present invention amorphous steel alloys with high manganese content and related method of using and manufacturing the same provide a variety of advantages. First, the present invention provides both the non-ferromagnetic properties at ambient temperature as well as useful mechanical attributes.

Another advantage of the present invention is that it provides a new class of ferrous-based bulk-solidifying amorphous metal alloys for non-ferromagnetic structural applications.

Thus, the present invention alloys exhibit magnetic transition temperatures below the ambient, mechanical strengths and hardness superior to conventional steel alloys, and good corrosion resistance.

Still yet, other advantages of the present invention include specific strengths as high as, for example, 0.5 MPa/(Kg/m3) (or greater), which are the highest among bulk metallic glasses.

Further, another advantage of the present invention is that it possesses thermal stability highest among bulk metallic glasses.

Moreover, another advantage of the present invention is that it has a reduced chromium content compared to current candidate Naval steels, for example.

Finally, another advantage of the present invention includes significantly lower ownership cost (for example, lower priced goods and manufacturing costs) compared with current refractory bulk metallic glasses.

The present invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims rather than by the foregoing description, and all changes which come within the meaning and range of equivalency of the claims are therefore intended to be embraced herein.

REFERENCES

The references as cited throughout this document and below are hereby incorporated by reference in their entirety.

1. "Synthesis and Properties of Ferromagnetic Bulk Amorphous Alloys", A. Inoue, T. Zhang, H. Yoshiba, and T. Itoi, in *Bulk Metallic Glasses*, edited by W. L. Johnson et al., Materials Research Society Proceedings, Vol. 554, (MRS Warrendale, Pa., 1999), p.251.
2. "The Formation and Functional Properties of Fe-Based Bulk Glassy Alloys", A. Inoue, A. Takeuchi, and B. Shen, Materials Transactions, JIM, Vol.42, (2001), p.970.
3. "New Fe—Cr—Mo—(Nb,Ta)—C—B Alloys with High Glass Forming Ability and Good Corrosion Resistance", S. Pang, T. Zhang, K. Asami, and A. Inoue, Materials Transactions, JIM, Vol.42, (2001), p.376.
4. "(Fe, Co)—(Hf, Nb)—B Glassy Thick Sheet Alloys Prepared by a Melt Clamp Forging Method", H. Fukumura, A. Inoue, H. Koshiba, and T. Mizushima, Materials Transactions, JIM, Vol.42, (2001), p.1820.
5. "Low Field Simultaneous AC and DC Magnetization Measurements of Amorphous $(Fe_{0.2}Ni_{0.9})_{75}P_{16}B_6Al_3$ and $(Fe_{0.68}Mn_{0.32})_{75}P_{16}B_6Al_3$", O. Beckmann et al., Physica Scripta, Vol. 25, (1982), p.676.
6. "Extremely Corrosion-Resistant Bulk Amorphous Alloys", K. Hashimoto et al., Materials Science Forum, Vol. 377, (2001), p.1.

We claim:

1. An Fe-based non-ferromagnetic amorphous steel alloy comprised substantially of a composition represented by the formula:

$$(Fe_{1-a-b-c}Mn_aCr_bMo_c)_{100-d-e-f}Zr_dNb_eB_f$$

wherein a, b, c, d, e, and f respectively satisfy the relations: $0.29 \geqq a \geqq 0.2$, $0.1 \geqq b \geqq 0$, $0.05 \geqq c \geqq 0$, $10 \geqq d \geqq 2$, $6 \geqq e \geqq 0$, $24 \geqq f \geqq 13$.

2. The Fe-based alloy as set forth in claim 1, wherein said Fe-based alloy has a temperature interval $\Delta T_x$ of at least about 60° C. as determined by the following formula:

$$\Delta T_x = T_x - T_g$$

wherein $T_x$ is an onset temperature of crystallization and $T_g$ is a glass transition temperature.

3. The Fe-based alloy as set forth in claim 1, wherein said Fe-based alloy has a reduced glass temperature of $T_{rg}$ of at least about 0.6, as determined by the following formula:

$$T_{rg} = T_g / T_l$$

wherein $T_g$ is the glass transition temperature and $T_l$ is the liquidus temperature, both in units of Kelvin.

4. The Fe-based alloy as set forth in claim 1, wherein said Fe-based alloy has a Curie point below about −100° C.

5. The Fe-based alloy as set forth in claim 1, wherein said Fe-based alloy has a spin-glass transition temperature below about −100° C.

6. The Fe-based alloy as set forth in claim 1, wherein B is at least partially substituted by one or both of elements C and Si.

7. The Fe-based alloy as set forth in claim 1, further comprising wherein Fe is at least partially substituted by Ni.

8. The Fe-based alloy as set forth in claim 1, wherein upon immersion in a 0.6M NaCl solution with pH of 6.001, said Fe-based alloy exhibits a passivating current of about $8\times10^{-7}$ to about $1\times10^{-6}$ A/cm$^2$, a passive region of about 0.8 V, and pitting potential of at least about +0.5 V.

9. The Fe-based alloy as set forth in claim 1, wherein said Fe-based alloy is processable into bulk amorphous samples of at least about 0.1 mm in thickness in its minimum dimension.

10. The Fe-based alloy as set forth in claim 1, wherein said Fe-based alloy is processable into bulk amorphous samples of at least about 0.5 mm in thickness in its minimum dimension.

11. The Fe-based alloy as set forth in claim 1, wherein said Fe-based alloy is processable into bulk amorphous samples of at least about 1.0 mm in thickness in its minimum dimension.

12. The Fe-based alloy as set forth in claim 1, wherein said Fe-based alloy is processable into bulk amorphous samples of at least about 10.0 mm in thickness in its minimum dimension.

13. The Fe-based alloy as set forth in claim 1, wherein said Fe-based alloy is processable into a corrosion resistant coating.

14. The Fe-based alloy as set forth in claim 1, wherein said Fe-based alloy is processable into a wear-resistant coating.

15. The Fe-based alloy as set forth in claim 1, wherein said Fe-based alloy is processable into a structure selected from the group consisting of ship frames, submarine frames, vehicle frames, ship parts, submarine parts, and vehicle parts.

16. The Fe-based alloy as set forth in claim 1, wherein said Fe-based alloy is processable into a structure selected from the group consisting of armor penetrators, projectiles, protection armors, rods, train rails, cable armor, power shaft, and actuators.

17. The Fe-based alloy as set forth in claim 1, wherein said Fe-based alloy is processable into a structure selected from the group consisting of engineering and medical materials and tools.

18. The Fe-based alloy as set forth in claim 1, wherein said Fe-based alloy is processable into a structure selected from the group consisting of cell phone and PDA casings, housings, and components, electronics and computer casings, housings and components.

19. An Fe-based amorphous steel alloy comprised substantially of a composition represented by the formula:

$$(Fe_{1-a-b-c}Mn_aCr_bMo_c)_{100-d-e-f}Zr_dNb_eB_f$$

wherein a, b, c, d, e, and f respectively satisfy the relations: $0.29 \geqq a \geqq 0.2$, $0.1 \geqq b \geqq 0$, $0.05 \geqq c \geqq 0$, $10 \geqq d \geqq 2$, $6 \geqq e \geqq 0$, $24 \geqq f \geqq 13$, and wherein said alloy has a critical cooling rate of less than about 1,000° C./sec.

20. An Fe-based amorphous steel alloy comprised substantially of a composition represented by the formula:

$$(Fe_{1-a-b-c}Mn_aCr_bMo_c)_{100-d-e-f}Zr_dNb_eB_f$$

wherein a, b, c, d, e, and f respectively satisfy the relations: $0.29 \geqq a \geqq 0.2$, $0.1 \geqq b \geqq 0$, $0.05 \geqq c \geqq 0$, $10 \geqq d \geqq 2$, $6 \geqq e \geqq 0$, $24 \geqq f \geqq 13$, and wherein said alloy is processable into bulk amorphous sample of at least about 0.1 mm in thickness in its minimum dimension.

21. An Fe-based non-ferromagnetic amorphous steel alloy comprised substantially of a composition represented by the formula (in atomic percent):

$$(Fe, Ni)_a(Mn, Cr, Mo, Zr, Nb)_b(B, Si, C)_c$$

wherein, $43 \geqq a \geqq 50$, $28 \geqq b \geqq 36$, $18 \geqq c \geqq 25$, and the sum of a, b, and c is 100 and under the following constraints that Fe content is at least about 40%, Mn content is at least about 13%, Zr content is at least about 3%, and B content is at least about 12% in the overall alloy composition.

22. An Fe-based amorphous steel alloy, having a critical cooling rate of less than about 1,000° C./sec, and comprised substantially of a composition represented by the formula (in atomic percent):

$$(Fe, Ni)_a(Mn, Cr, Mo, Zr, Nb)_b(B, Si, C)_c$$

wherein, $43 \geqq a \geqq 50$, $282b \geqq 36$, $18 \geqq c \geqq 25$, and the sum of a, b, and c is 100 and under the following constraints that Fe content is at least about 40%, Mn content is at least about 13%, Zr content is at least about 3%, and B content is at least about 12% in the overall alloy composition.

23. An article of Fe-based amorphous steel alloy, having minimum dimension of at least about 0.1 mm, and comprised substantially of a composition represented by the formula (in atomic percent):

$$(Fe, Ni)_a(Mn, Cr, Mo, Zr, Nb)_b(B, Si, C)_c$$

wherein, $43 \geqq a \geqq 50$, $28 \geqq b \geqq 36$, $18 \geqq c \geqq 25$, and the sum of a, b, and c is 100 and under the following constraints that Fe content is at least about 40%, Mn content is at least about 13%, Zr content is at least about 3%, and B content is at least about 12% in the overall alloy composition.

24. An Fe-based non-ferromagnetic amorphous steel alloy comprised substantially of a composition represented by the formula:

$$Fe_{100-a-b-c-d-e}Mn_aMo_bCr_cB_dC_e$$

wherein a, b, c, d, and e respectively satisfy the relations: $13 \geqq a \geqq 8$, $17 \geqq b \geqq 12$, $5 \geqq c \geqq 0$, $7 \geqq d \geqq 4$, $17 \geqq e \geqq 13$, these subscript values indicating the atomic percent amounts of the constituent elements of the composition; and wherein said Fe-based alloy is processable into bulk amorphous samples having a thickness in its minimum dimension in one of the following ranges:

at least about 0.5 mm, at least about 1 mm, or at least about 10 mm.

25. An Fe-based amorphous steel alloy comprised substantially of a composition represented by the formula:

$$Fe_{100-a-b-c-d-e}Mn_aMo_bCr_cB_dC_e$$

wherein a, b, c, d, and e respectively satisfy the relations: $13 \geqq a \geqq 8$, $17 \geqq b \geqq 12$, $5 \geqq c \geqq 0$, $7 \geqq d \geqq 4$, $17 \geqq e \geqq 13$, these subscript values indicating the atomic percent amounts of the constituent elements of the composition; and wherein said alloy has a critical cooling rate of less than about 1,000° C./sec.

26. An Fe-based amorphous steel alloy, having a critical cooling rate of less than about 1,000°C./sec, and comprised substantially of a composition represented by the formula (in atomic percent):

$$(Fe)_a\ (Mn, Cr, Mo)_b\ (B, C)_c$$

wherein $45 \geqq a \geqq 55$, $23 \geqq b \geqq 33$, $18 \geqq c \geqq 24$, and the sum of a, b, and c is 100 and under the following constraints that Mo content is at least about 12%, Mn content is at least about 7%, Cr content is at least about 3%, C content is at least about 13%, and B content is at least about 4% in the overall alloy composition.

27. An Fe-based non-ferromagnetic amorphous steel alloy comprised substantially of a composition having the formula:

$$Fe_{100-a-b-c-d-e-f}Mn_aMo_bCr_cB_dP_eC_f$$

wherein a, b, c, d, e, and f respectively satisfy the relations: $15 \geqq a \geqq 5$, $14 \geqq b \geqq 8$, $10 \geqq c \geqq 4$, $8 \geqq d \geqq 0$, $12 \geqq e \geqq 5$, $16 \geqq f \geqq 4$, these subscript values indicating the atomic percent amounts of the constituent elements of the composition.

28. The Fe-based alloy as set forth in claim 27, wherein said Fe-based alloy has a temperature interval $\Delta T_x$ of at least about 45° C. as determined by the following formula:

$$\Delta T_x = T_x - T_g$$

wherein $T_x$, is an onset temperature of crystallization and $T_g$ is a glass transition temperature.

29. The Fe-based alloy as set forth in claim 27, wherein said Fe-based alloy has a glass transition temperature of $T_g$ of at least about 480° C.

30. The Fe-based alloy as set forth in claim 27, wherein said Fe-based alloy has a reduced glass temperature of $T_{rg}$ of at least about 0.60° as determined by the following formula:

$$T_{rg}=T_g/T_l$$

wherein $T_g$ is the glass transition temperature and $T_l$ is the liquidus temperature, both in units of Kelvin.

31. The Fe-based alloy as set forth in claim 27, wherein said Fe-based alloy has a Curie point below −100° C.

32. The Fe-based alloy as set forth in claim 27, wherein said Fe-based alloy has a spin-glass transition temperature below about −100° C.

33. The Fe-based alloy as set forth in claim 27, wherein said Fe-based alloy is processable into bulk amorphous samples of at least about 0.1 mm in thickness in its minimum dimension.

34. The Fe-based alloy as set forth in claim 27, wherein said Fe-based alloy is processable into bulk amorphous samples of at least about 0.5 mm in thickness in its minimum dimension.

35. The Fe-based alloy as set forth in claim 27, wherein said Fe-based alloy is processable into bulk amorphous samples of at least 1.0 mm in thickness, in its minimum dimension.

36. The Fe-based alloy as set forth in claim 27, wherein said Fe-based alloy is processable into bulk amorphous samples of at least about 10.0 mm in thickness in its minimum thickness.

37. The Fe-based alloy as set forth in claim 27, wherein said Fe-based alloy is processable into a corrosion resistant coating,.

38. The Fe-based alloy as set forth in claim 27, wherein said Fe-based alloy is processable into a wear-resistant coating.

39. The Fe-based alloy as set forth in claim 27, wherein said Fe-based alloy is processable into a structure selected from the group consisting of ship frames, submarine frames, vehicle frames, ship parts, submarine parts, and vehicle parts.

40. The Fe-based alloy as set forth in claim 27, wherein said Fe-based alloy is processable into a structure selected from the group consisting of armor penetrators, projectiles, protection armors, rods, train rails, cable armor, power shaft, and actuators.

41. The Fe-based alloy as set forth in claim 27, wherein said Fe-based alloy is processable into a structure selected from the group consisting of engineering and medical materials and tools.

42. The Fe-based alloy as set forth in claim 27, wherein said Fe-based alloy is processable into a structure selected from the group consisting of cell phone and PDA casings, housings, and components, electronics and computer casings, housings and components.

43. An Fe-based amorphous steel alloy comprised substantially of a composition having the formula:

$$Fe_{100-a-b-c-d-e-f}Mn_aMo_bCr_cB_dP_eC_f$$

wherein a, b, c, d, e, and f respectively satisfy the relations: 15≧a≧5, 14≧b≧8, 10≧c≧4, 8≧d≧0, 12≧e≧5, 16≧f≧4, these subscript value indicating the atomic percent amounts of the constituent elements of the composition; and wherein said alloy has a critical cooling rate of less than about 1,000° C./sec.

44. An Fe-based amorphous steel alloy comprised substantially of a composition having the formula:

$$Fe_{100-a-b-c-d-e-f}Mn_aMo_bCr_cB_dP_eC_f$$

wherein a, b, c, d, e, and f respectively satisfy the relations: 15≧a≧5, 14≧b≧8, 10≧c≧4, 8≧d≧0, 12≧e≧5, 16≧f≧4, these subscript value indicating the atomic percent amounts of the constituent elements of the composition; and wherein said alloy is processable into bulk amorphous sample of at least about 0.1 mm in thickness in its minimum dimension.

45. An Fe-based non-ferromagnetic amorphous steel alloy comprised substantially of a composition represented by the formula (in atomic percent):

$$(Fe)_a(Mn, Cr, Mo)_b(B, P, C)_c$$

wherein, 47≧a≧59, 20≧b≧32, 19≧c≧23, and the sum of a, b, and c is 100 and under the following constraints that Mo content is at least about 7%, Mn content is at least about 4%, Cr content is 3%, C content is at least about 3%, P content is at least about 4%, and B content is at least about 4% in the overall alloy composition.

46. An Fe-based amorphous steel alloy, having a critical cooling rate of less than about 1,000° C./sec, and comprised substantially of a composition represented by the formula (in atomic percent):

$$(Fe)_a(Mn, Cr, Mo)_b(B, P, C)_c$$

wherein, 47≧a≧59, 20≧b≧32, 19≧c≧23, and the sum of a, b, and c is 100 and under the following constraints that Mo content is at least about 7%, Mn content is at least about 4%, Cr content is at least about 3%, C content is 3%, P content is at least about 4%, and B content is at least about 4% in the overall alloy composition.

47. An article of Fe-based amorphous steel alloy, having minimum dimension of at least about 0.5 mm, and comprised substantially of a composition represented by the formula (in atomic percent):

$$(Fe)_a(Mn, Cr, Mo)_b(B, P, C)_c$$

wherein, 47≧a≧59, 20≧b≧32, 19≧c≧23, and the sum of a, b, and c is 100 and under the following constraints that Mo content is at least about 7%, Mn content is at least about 4%, Cr content is at least about 3%, C content is at least about 3%, P content is at least about 4%, and B content is at least about 4% in the overall alloy composition.

* * * * *